US008950219B2

(12) United States Patent
Park et al.

(10) Patent No.: US 8,950,219 B2
(45) Date of Patent: Feb. 10, 2015

(54) WASHING MACHINE AND CONTROL METHOD THEREOF

(75) Inventors: Jae Seuk Park, Yingin-si (KR); Moo Hyung Lee, Seoul (KR); Il Sung Bae, Yongin-si (KR); Sung Jong Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 108 days.

(21) Appl. No.: 13/432,721

(22) Filed: Mar. 28, 2012

(65) Prior Publication Data

US 2012/0278996 A1 Nov. 8, 2012

(30) Foreign Application Priority Data

May 4, 2011 (KR) ..... 10-2011-0042611

(51) Int. Cl.

| | |
|---|---|
| ***D06F 37/02*** | (2006.01) |
| ***D06F 33/02*** | (2006.01) |
| ***D06F 37/22*** | (2006.01) |
| ***D06F 37/20*** | (2006.01) |

(52) U.S. Cl.

CPC ..... *D06F 37/225* (2013.01); *D06F 33/02* (2013.01); *D06F 37/203* (2013.01); *D06F 2222/00* (2013.01)

USPC ..... 68/12.06; 68/23.2

(58) Field of Classification Search

CPC ..... D06F 33/02; D06F 37/203; D06F 37/225; D06F 2222/00

USPC ..... 68/12.06, 23.1, 23.2, 24

See application file for complete search history.

(56) References Cited

U.S. PATENT DOCUMENTS

| | | | | |
|---|---|---|---|---|
| 5,813,253 | A | 9/1998 | Uhlin | |
| 2006/0096332 | A1 * | 5/2006 | won Chang | 68/12.24 |
| 2007/0251023 | A1 * | 11/2007 | Koo et al. | 8/158 |
| 2008/0066238 | A1 * | 3/2008 | Lee et al. | 8/159 |
| 2009/0217711 | A1 * | 9/2009 | May | 68/12.04 |
| 2010/0147038 | A1 * | 6/2010 | Dudzik et al. | 68/12.02 |
| 2010/0175199 | A1 * | 7/2010 | Kim et al. | 8/137 |
| 2012/0017646 | A1 * | 1/2012 | Chae et al. | 68/12.02 |
| 2012/0144871 | A1 * | 6/2012 | Hardaway | 68/12.02 |
| 2012/0192362 | A1 * | 8/2012 | Lee et al. | 8/137 |

FOREIGN PATENT DOCUMENTS

| | | | |
|---|---|---|---|
| EP | 2 514 864 | A2 | 10/2012 |
| KR | 1020060088720 | A * | 8/2006 |

OTHER PUBLICATIONS

Machine translation of KR 10-2006-0088720A, no date.*

European Search Report dated Jul. 6, 2012 in application No. EP 12 16 5877.7.

European Office Action issued Nov. 29, 2013 in corresponding European Application No. 12 165 877.7.

* cited by examiner

*Primary Examiner* — Joseph L Perrin

(74) *Attorney, Agent, or Firm* — Staas & Halsey LLP

(57) ABSTRACT

A washing machine which improves performance of balancers, and a control method thereof. The washing machine includes a drum accommodating laundry and rotated by rotary force transmitted from a drive source, balancer housings mounted on the drum, each of the balancer housings including a disc-shaped channel formed therein, balancing modules movably disposed in the channels of the balancer housings, vibration sensors to sense unbalance applied to the drum during rotation of the drum, position sensors to sense the positions of the balancing modules, and a controller controlling movement of the balancing modules to positions to compensate for the unbalance sensed by the vibration sensors.

8 Claims, 11 Drawing Sheets

1

WASHING MACHINE AND CONTROL METHOD THEREOF

CROSS-REFERENCE TO RELATED APPLICATIONS

This application claims the benefit of Korean Patent Application No. 2011-0042611, filed on May 4, 2011 in the Korean Intellectual Property Office, the disclosure of which is incorporated herein by reference.

BACKGROUND

1. Field

Embodiments of the present invention relate to a washing machine having balancers to compensate for unbalance.

2. Description of the Related Art

A washing machine includes a drum to accommodate laundry, such as clothes, and a motor to drive the drum, and conducts a series of operations, such as washing, rinsing and spin-drying cycles, using rotation of the drum.

When laundry is not uniformly distributed in the drum and is concentrated at a specific region during rotation of the drum, the drum is eccentrically rotated and thus generates vibration and noise, and if such vibration and noise is severe, components, such as the drum and the motor, may be damaged.

A washing machine is provided with balancers which compensate for unbalanced load generated within the drum to stabilize rotation of the drum.

SUMMARY

It is an aspect of the present invention to provide a washing machine which improves performance of balancers, and a control method thereof.

Additional aspects will be set forth in part in the description which follows and, in part, will be obvious from the description, or may be learned by practice of the invention.

In accordance with one aspect, a washing machine includes a drum accommodating laundry and rotated by rotary force transmitted from a drive source, balancer housings mounted on the drum, each of the balancer housings including a disc-shaped channel formed therein, balancing modules movably disposed in the channels of the balancer housings, vibration sensors to sense unbalance applied to the drum during rotation of the drum, position sensors to sense the positions of the balancing modules, and a controller controlling movement of the balancing modules by detecting the position of the unbalance based on a result of sensing by the vibration sensors and detecting the positions of the balancing modules based on a result of sensing by the position sensors, calculating moving positions of the balancing modules to compensate for the unbalance based on the detected positions, and transmitting moving signals to move the balancing module to the calculated positions.

The drum may include a first position identification unit mounted on the external surface of the drum and sensed by the position sensors, and each of the balancing modules may include a mass body, a power supply unit to supply power, a communication unit to receive the moving signal from the controller, a drive unit to generate drive force to move the balancing module within the balancing housing according to the moving signal, and a second position identification unit sensed by the position sensors to sense the position of each of the balancing modules.

Each of the position sensors may include one of a Hall sensor, an infrared sensor and an optical fiber sensor.

Each of the position identification units may include one of a magnetic body, a light emitting unit and a reflective plate.

The position sensors may include a first position sensor to sense the first position identification unit and to generate a reference signal to detect a position of the unbalance and to detect positions of the balancing modules, and second position sensors, each of which senses the second position identification unit.

The controller may detect the intensity of the unbalance through signals sensed by the vibration sensors, and detect the relative position of the unbalance with respect to the position of the first position identification unit through phase differences between the reference signal of the first position sensor and the signals sensed by the vibration sensors.

The controller may detect the relative positions of the balancing modules with respect to the position of the first position identification unit through phase differences between the reference signal of the first position sensor and signals sensed by the second position sensors, determine positions of the balancing modules to compensate for the unbalance, and move the balancing modules to the determined positions.

The vibration sensors may be mounted at front and rear ends of the external surface of the tub.

The drum may include a cylindrical member and front and rear plates respectively disposed at the front and rear portions of the cylindrical member, the balancing housings may include a first balancer housing and a second balancer housing overlapping each other in the direction of a rotary axis of the drum, and the first balancer housing and the second balancer housing may be respectively mounted on the front plate and the rear plate.

The balancing modules may have a rod shape extending in the circumferential direction of the disc-shaped channel.

In accordance with another aspect, a control of a washing machine, which includes a drum, balancer housings mounted on the drum, and balancing modules movably disposed in the balancer housings, includes rotating the drum, detecting a vibration value of a tub of the washing machine, when the RPM of the drum has reached a first RPM, detecting a position of unbalance applied to the drum and positions of the balancing modules within the balancer housings, when the detected vibration value of the tub is more than a predetermined reference value, determining positions of the balancing modules to compensate for the unbalance applied to the drum, and controlling the balancing modules to move to the determined positions.

The washing machine may further include vibration sensors mounted on the tub, a first position identification unit mounted on the drum, second position identification units mounted on the balancing modules, a first position sensor to sense the first position identification unit and to generate a reference signal to detect the position of the unbalance and to detect the positions of the balancing modules, and second position sensors to sense the second position identification units.

The detection of the unbalance applied to the drum may include detecting the relative position of the unbalance with respect to the first position identification unit through phase differences between the reference signal of the first position sensor and signals sensed by the vibration sensors.

The detection of the positions of the balancing modules within the balancer housings may include detecting the relative positions of the balancing modules with respect to the first position identification unit through phase differences between the reference signal of the first position sensor and signals sensed by the second position sensors.

The determination of the positions of the balancing modules to compensate for the unbalance applied to the drum may include determining positions of the balancing modules to apply force corresponding to the intensity of the unbalance in the opposite direction to the direction of the unbalance.

The control of the balancing modules to move to the determined positions may include controlling the balancing modules to move to the determined positions by generating signals to move the balancing modules to the determined positions and transmitting the signals to the balancing modules.

The control method may further include re-detecting the vibration value of the tub and comparing the vibration value with the reference value, after the control of the balancing modules to move to the determined positions.

The control method may further include, when the detected vibration value of the tub is not more than the predetermined reference value, increasing the RPM of the drum, judging whether or not the RPM of the drum reaches a second RPM, detecting the vibration value of the tub, upon judging that the RPM of the drum has not reached the second RPM, detecting the position of the unbalance applied to the drum and the positions of the balancing modules within the balancer housings, when the detected vibration value of the tub is more than the predetermined reference value, determining the positions of the balancing modules to compensate for the unbalance applied to the drum, controlling the balancing modules to move to the determined positions, and re-detecting the vibration value of the tub and comparing the vibration value with the reference value, when the balancing modules move to the determined positions.

The control method may further include, upon judging that the RPM of the drum has reached the second RPM, judging whether or not a spin-drying cycle time which is input in advance has passed, detecting the vibration value of the tub, upon judging that the spin-drying cycle time has not passed, detecting the position of the unbalance applied to the drum and the positions of the balancing modules within the balancer housings, when the detected vibration value of the tub is more than the predetermined reference value, determining the positions of the balancing modules to compensate for the unbalance applied to the drum, controlling the balancing modules to move to the determined positions, and re-detecting the vibration value of the tub and comparing the vibration value with the reference value, when the balancing modules move to the determined positions.

The control method may further include judging whether or not the spin-drying cycle time has passed, when the detected vibration value of the tub is not more than the predetermined reference value.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
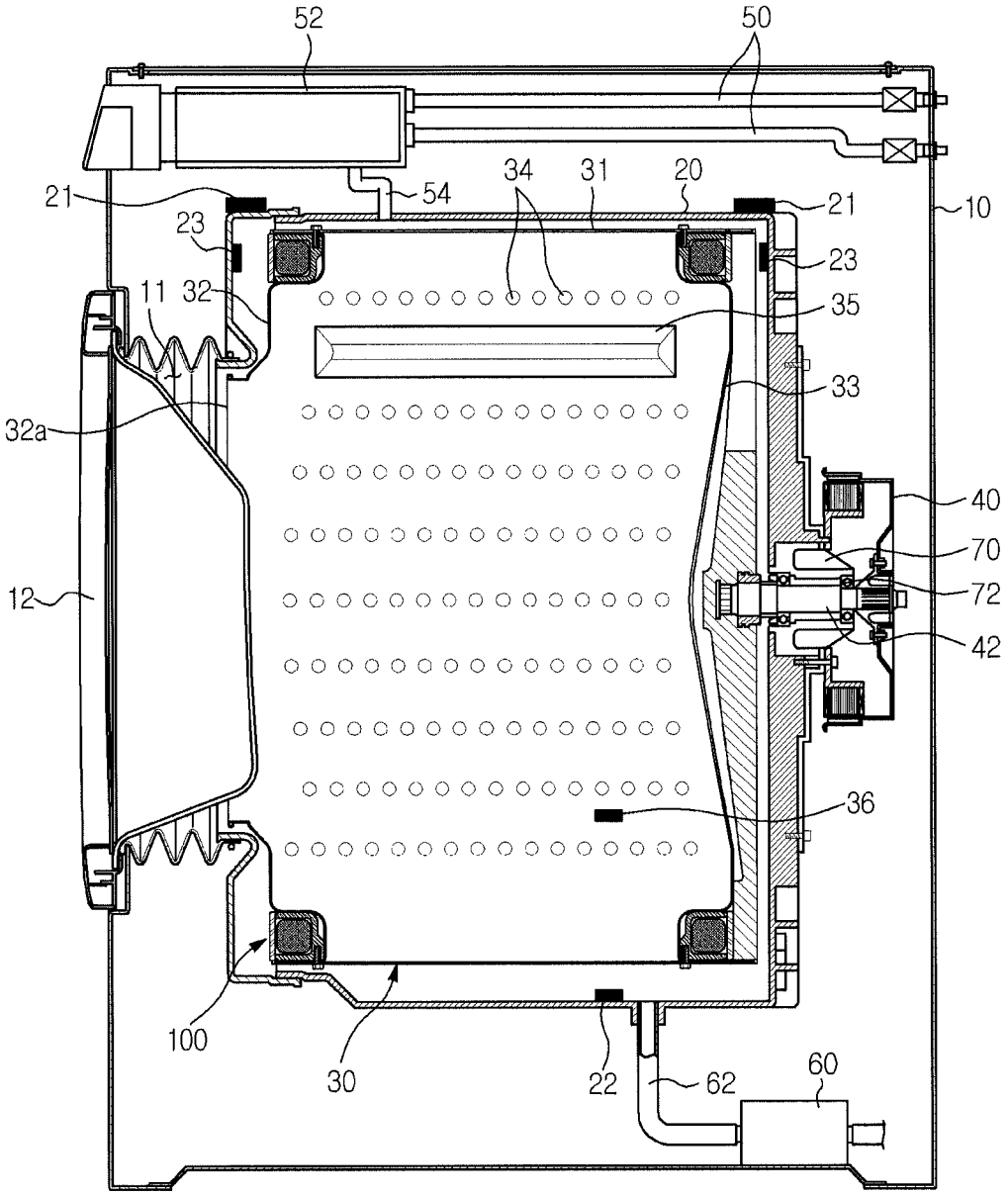
FIG. 1 is a longitudinal-sectional view illustrating the configuration of a washing machine in accordance with one embodiment of the present invention.

Reference will now be made in detail to the embodiments of the present invention, examples of which are illustrated in the accompanying drawings, wherein like reference numerals refer to like elements throughout. In the drawings, the same or similar elements are denoted by the same reference numerals even though they are depicted in different drawings.

FIG. 1 is a longitudinal-sectional view illustrating the configuration of a washing machine in accordance with one embodiment.

As shown in FIG. 1, a washing machine 1 includes a cabinet 10 forming the external appearance of the washing machine 1, a tub 20 disposed within the cabinet 10, a drum 30 rotatably disposed within the tub 20, and a motor 40 to drive the drum 30.

An inlet 11 through which laundry is put into the drum 20 is formed on the front surface of the cabinet 10. The inlet 11 is opened and closed by a door 12 installed on the front surface of the cabinet 10.

Water supply pipes 50 to supply wash water to the tub 20 are installed above the tub 20. One end of each of the water supply pipes 50 is connected to an external water supply source (not shown), and the other end of each of the water supply pipes 50 is connected to a detergent supply device 52.

The detergent supply device 52 is connected to the tub 20 through a connection pipe 54. Water supplied through the water supply pipe 50 is supplied to the detergent supply device 52 and is mixed with detergents in the detergent supply device 52, and the water mixed with the detergents is supplied to the inside of the tub 20.

A drain pump 60 and a drain pipe 62 to discharge water in the tub 20 to the outside of the cabinet 10 are installed under the tub 20.

Vibration sensors 21 are mounted on the external surface of the tub 20. The vibration sensors 20 are mounted at both ends of the tub 20 in the forward and backward directions and detect distribution of unbalance applied to the tub 20 in the forward and backward directions.

The drum 30 includes a cylindrical member 31, a front plate 32 disposed at the front portion of the cylindrical member 31, and a rear plate 33 disposed at the rear portion of the cylindrical member 31. An opening 32*a* through which laundry is put into and taken out of the drum 30 is formed through the front plate 32, and a drive shaft 42 to transmit power of the motor 40 is connected to the rear plate 33.

A plurality of through holes 34 to circulate wash water is provided on the circumference of the drum 30, and a plurality of lifters 35 to tumble laundry when the drum 30 is rotated is installed on the inner circumferential surface of the drum 30.

The drive shaft 42 is disposed between the drum 30 and the motor 40. One end of the drive shaft 42 is connected to the rear plate 33 of the drum 30, and the other end of the drive shaft 42 extends to the outside of the rear wall of the tub 20. When the motor 40 drives the drive shaft 42, the drum 30 connected to the drive shaft 42 is rotated about the drive shaft 42.

A first position identification unit 36 is mounted at a random position of the external surface of the drum 30. Here, the first position identification unit 36 may be a magnetic body including a permanent magnet, a light emitting unit to emit light, or a reflective plate to reflect irradiated light. In order to sense the first position identification unit 36 mounted on the external surface of the drum 30, a first position sensor 22 may be mounted on the inner surface of the tub 20. The first position sensor 22 senses the first position identification unit 36 mounted on the external surface of the drum 30 during rotation of the drum 30, generates a sensing signal, and then transmits the sensing signal to a controller 80. Here, the first position sensor 22 may be a Hall sensor, an infrared sensor, or an optical fiber sensor. If the first position sensor 22 is a Hall sensor, the first position identification unit 36 may be a magnetic body, if the first position sensor 22 is an infrared sensor, the first position identification unit 36 may be a light emitting unit, and if the first position sensor 22 is an optical fiber sensor, the first position identification unit 36 may be a reflective plate. The Hall sensor may sense magnetic force of the magnetic body to generate a sensing signal, the infrared sensor may receive light irradiated from the light emitting unit to generate a sensing signal, and the optical fiber sensor may receive light reflected by the reflective plate to generate a sensing signal.

Further, second position sensors 23 are mounted at random positions of the inner surface of the tub 20 opposite to disc-shaped balancers 100 mounted on the front and rear surfaces of the drum 30. The second position sensor 23 senses a second position identification unit 125 mounted on a balancing module 113 (with reference to FIG. 2), generates a sensing signal, and then transmits the signal to the controller 80. Here, the configurations of the second position identification units 125 and the second position sensors 23 are the same as those of the above-described first position identification unit 36 and the first position sensor 22, and a detailed description thereof will thus be omitted.

The controller 80 may detect the positions of the balancing modules 113 through the sensing signal of the first position sensor 22 and the sensing signals of the second position sensors 23. This will be described in more detail later.

A bearing housing 70 to rotatably support the drive shaft 42 is installed on the rear wall of the tub 20. The bearing housing 70 may be formed of an aluminum alloy, and be inserted into the rear wall of the tub 20 when the tub 20 is produced through injection molding. Bearings 72 to facilitate rotation of the drive shaft 42 are installed between the bearing housing 70 and the drive shaft 42.

During a washing cycle, the motor 40 rotates the drum 30 at a low velocity in a regular direction and in the reverse direction, and thereby tumbling of the laundry within the drum 30 is repeated, thus removing contaminants from the laundry.

During a spin-drying cycle, when the motor 40 rotates the drum at a high velocity in one direction, water is separated from the laundry by centrifugal force applied to the laundry.

When the laundry is not uniformly distributed within the drum 30 and is concentrated at a specific region during rotation of the drum 30 in the spin-drying process, rotation of the drum 30 becomes unstable and thus causes vibration and noise.

Therefore, the washing machine 1 is provided with the balancers 100 to stabilize rotation of the drum 30. FIG. 1 illustrates the washing machine 1 to which the balancers 100 of FIG. 2 are applied.

Figure 2:
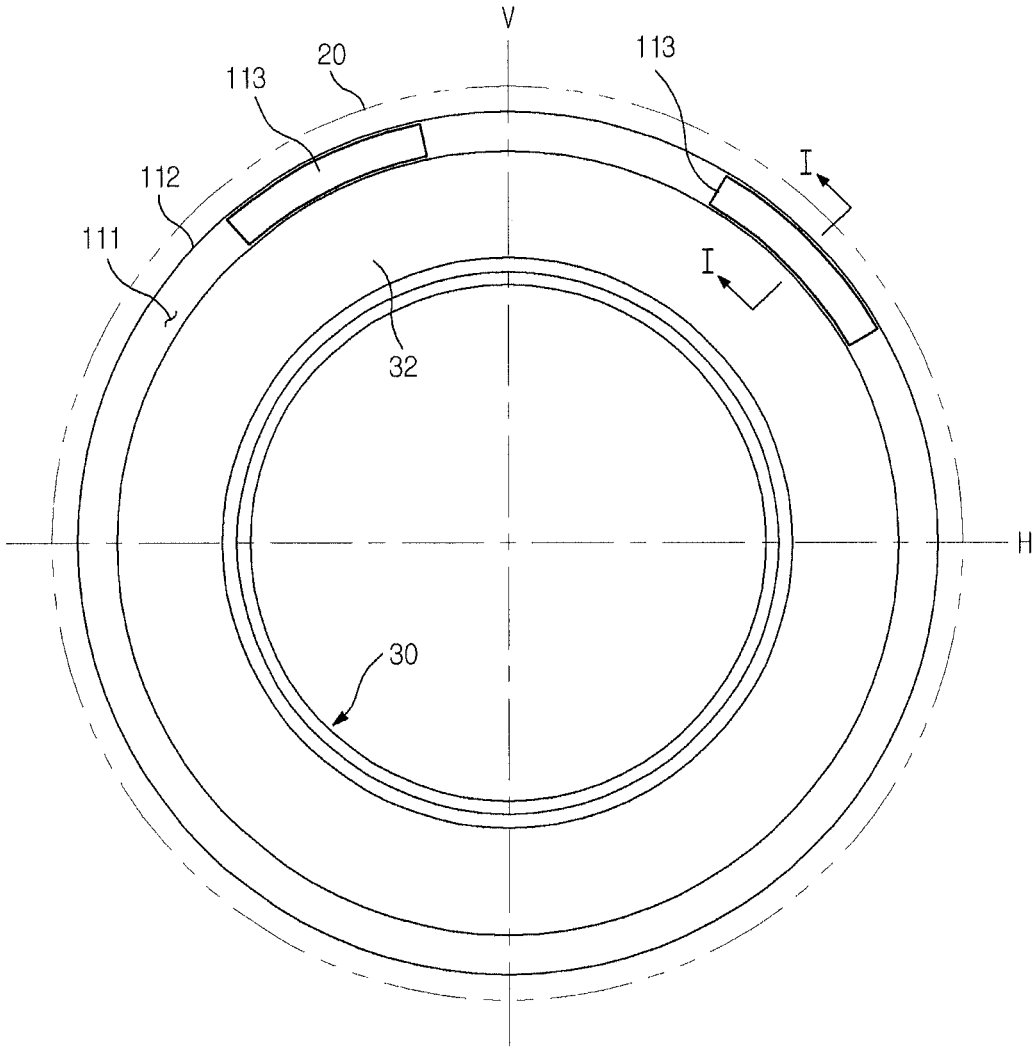
FIG. 2 is a plan view illustrating the configuration of a balancer of the washing machine in accordance with the embodiment of the present invention.
Figure 3:
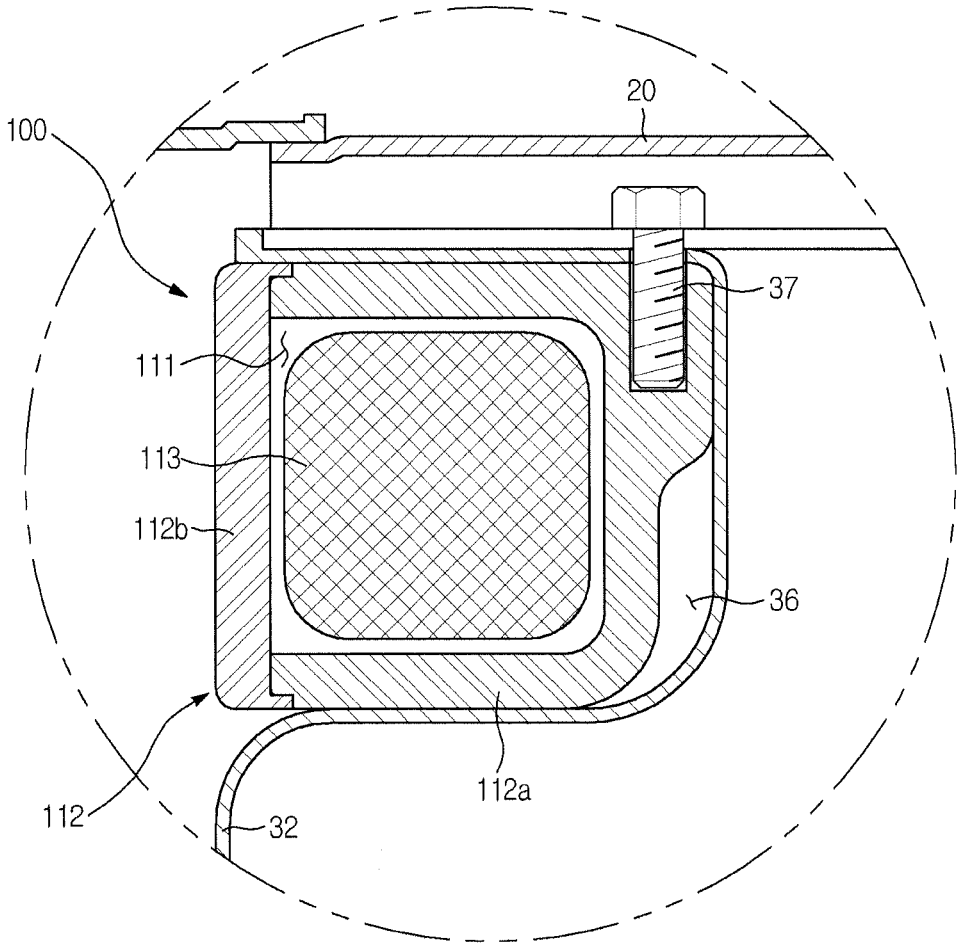
FIG. 3 is a cross-sectional view taken along the line I-I of FIG. 2.

FIG. 2 is a plan view illustrating the configuration of the balancer of the washing machine in accordance with the embodiment of the present invention, and FIG. 3 is a cross-sectional view taken along the line I-I of FIG. 2.

As shown in FIGS. 2 and 3, the balancer 100 includes a balancer housing 112 and balancing modules 113.

The balancer housing 112 is provided with a disc-shaped channel 111, and the balancing modules 113 are movably disposed in the channel 111. The balancing modules 113 may move within the channel 111 so as to compensate for unbalanced load present in the drum 30 during rotation of the drum 30.

The balancer 100 may be mounted on the front plate 32 of the drum 30. A disc-shaped recess 36 having an opened front surface is formed on the front plate 32 of the drum 30, and the balancer housing 112 is accommodated in the recess 36. The balancer housing 112 may be connected to the drum 30 through fastening members 37 so as to be firmly fixed to the drum 30. Further, the balancer 100 may be mounted on the rear plate 33 of the drum 30 in the same manner.

The balancer housing 112 includes a disc-shaped housing body **112*a* having an opening formed on one side surface, and a cover 112*b* to cover the opening. The inner surface of the housing body 112*a* and the inner surface of the cover 112*b* define the disc-shaped channel 111**.

The channel 111 may have a rectangular cross-section and the balancing modules 113 may have a rectangular cross-section, as shown in FIG. 3. The balancing modules 113 may be provided to have a square pillar shape extending in the circumferential direction of the channel 111. However, the balancing modules 113 are not limited to the square pillar shape, and may have a cylinder shape or a polygonal prism shape. Further, the cross-sectional shape of the balancing modules 113 may be changed in the circumferential direction of the channel 111.

Figure 4:
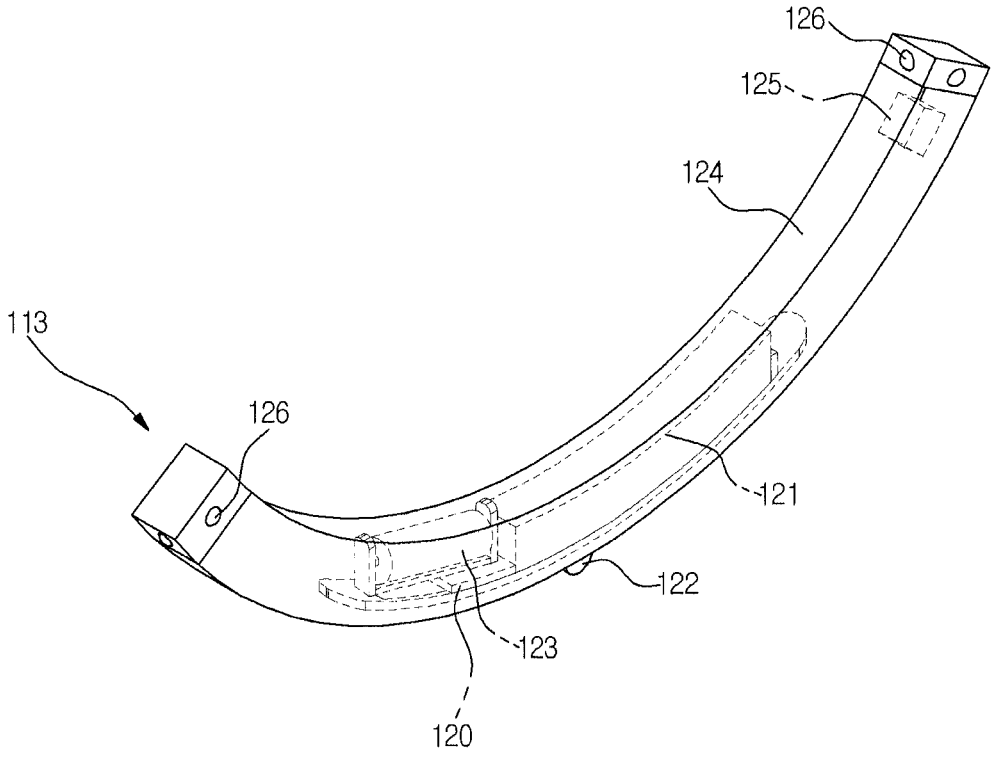
FIG. 4 is a perspective view illustrating the configuration of a balancing module of the washing machine in accordance with the embodiment of the present invention.

FIG. 4 is a perspective view illustrating the configuration of the balancing module 113 of the washing machine 1 in accordance with the embodiment of the present invention.

The balancing module 113 includes a communication unit 120 to receive a moving signal from the controller 80, a drive unit 121 to provide drive force to move the balancing module 113 within the channel 111 of the balancing housing 112 according to the moving signal received from the controller 80, a wheel 122 rotated by the drive force from the drive unit 121, a power supply unit 123 to supply power to the balancing module 113, a mass body 124, the second position identification unit 125 allowing the second position sensor 23 to sense the position of the balancing module 113, and balls 126 to reduce frictional force generated when the balancing module 113 moves along the channel 111.

The communication unit 120 is a wireless communication module to conduct communication with the controller 80, and may employ an RF communication method including ZigBee. The controller 80 moves the balancing modules 113 to compensate for unbalance generated due to rotation of the drum 30 when laundry is not uniformly distributed within the drum 30 but is concentrated at a specific region. The controller 80 determines a position to which the balancing module 113 is to move and transmits a corresponding signal to the balancing module 113, and the communication unit 120 of the balancing module 113 receives the signal.

The drive unit 121 generates drive force to move the balancing module 113 to the position to compensate for the unbalance according to the moving signal received from the controller 80, and drives the wheel 122 using the generated drive force, thereby moving the balancing module 113 to the target position. The drive unit 121 may include a motor to generate drive force, and a gear box having a specific reduction ratio to adjust drive force of the motor.

The wheel 122 is driven by drive force of the drive unit 121, and moves the balancing module 113 to the target position in the channel 112 of the balancer housing 112. Although FIG. 4 illustrates one wheel, one or more wheels may be used.

The power supply unit 123 supplies power to the balancing module 113. The power supply unit 123 supplies power required for generation of drive force to move the balancing module 113 and communication of the communication unit 120. The power supply unit 123 may be a rechargeable battery.

The mass body 124 may be formed of steel, but is not limited thereto.

The second position identification unit 125 may be a magnetic body including a permanent magnet, a light emitting unit to emit light, or a reflective plate to reflect irradiated light, and may be mounted at a random position within the balancing module 113.

The balls 126 may be respectively installed on sloping surfaces of the balancing module 113 to reduce friction force generated due to friction of the balancing module 113 with the inner wall of the channel 111 when the balancing module 113 moves along the channel 111. The balls 126 are rotated when the balls 126 rub against the inner wall of the channel 111, thereby reducing friction force.

Figure 5:
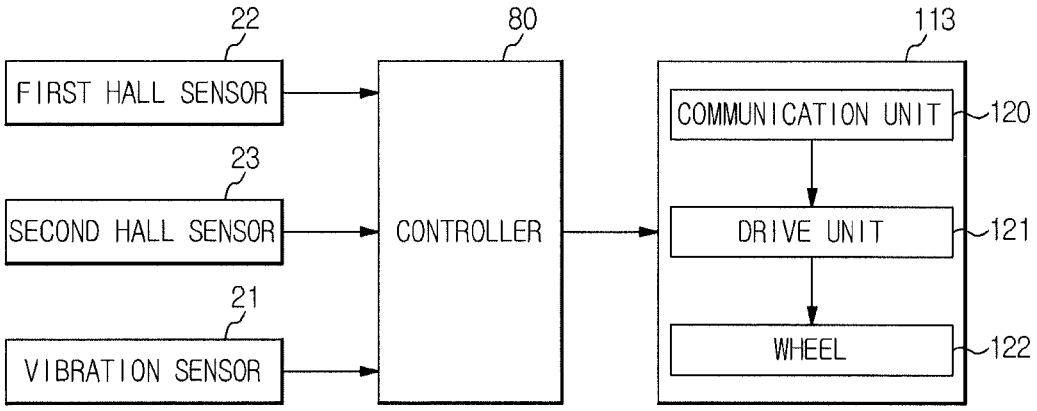
FIG. 5 is a block diagram illustrating control of balancing modules of the washing machine in accordance with the embodiment of the present invention.

FIG. 5 is a block diagram illustrating control of the balancing modules 113 of the washing machine 1 in accordance with the embodiment of the present invention. Hereinafter, a control process of the balancing modules 113 on the assumption that the position sensors and the position identification units are Hall sensors and magnetic bodies will be described.

As shown in FIG. 5, the washing machine 1 includes the vibration sensors 21, the first Hall sensor 22, the second Hall sensors 23, the controller 80 and the balancing modules 113.

The vibration sensors 21 serve to sense the intensity and direction of unbalance applied to the drum 30 during rotation of the drum 30, and may be mounted at both ends in the forward and backward directions of the tub 20 on the external surface of the tub 20 to detect distribution of unbalance applied to the tub 20 in the forward and backward directions of the tub 20.

The first Hall sensor 22 may be installed around the first magnetic body 36 to sense the first magnetic body 36 mounted on the external surface of the drum 30. Preferably, the first Hall sensor 22 is installed on the inner wall of the tub 20 at a position opposite to the first magnetic body 36. The second Hall sensors 23 may be installed around the balancer housings 112 respectively installed on the front plate 32 and the rear plate 33 of the drum 30 to sense the second magnetic bodies 125 of the balancing modules 113, and is preferably installed on the inner wall of the tub 20 at positions opposite to the balancer housings 112.

The controller 80 detects positions of the balancing modules 113 in the housings 112 from a result of sensing by the first Hall sensor 22 and the second Hall sensors 23.

When the magnetic body passes by the Hall sensor, the Hall sensor senses magnetic force of the magnetic body and generates a signal of a pulse waveform. The first Hall sensor 22 senses the first magnetic body 36 mounted on the external surface of the drum 30 and thus generates one pulse per rotation. Since the second Hall sensor 23 senses the second magnetic body 125 mounted on the balancing module 113, the second Hall sensor 23 generates two pulses per rotation if two balancing modules 113 are disposed in one balancer 100, and generates one pulse per rotation if one balancing module 113 is disposed in one balancer 100.

Figure 6:
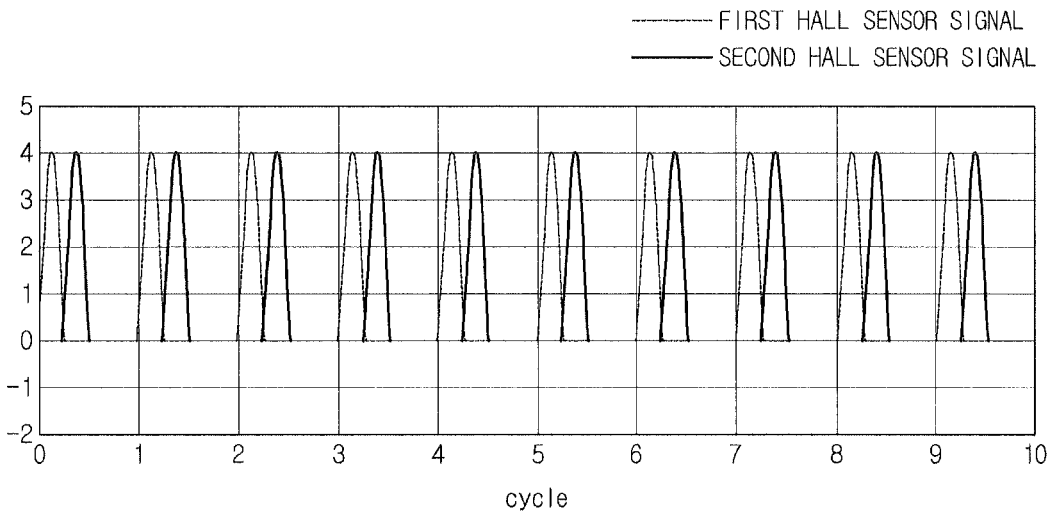
FIG. 6 is a graph representing signal waveforms of Hall sensors of the washing machine in accordance with the embodiment of the present invention.
Figure 7:
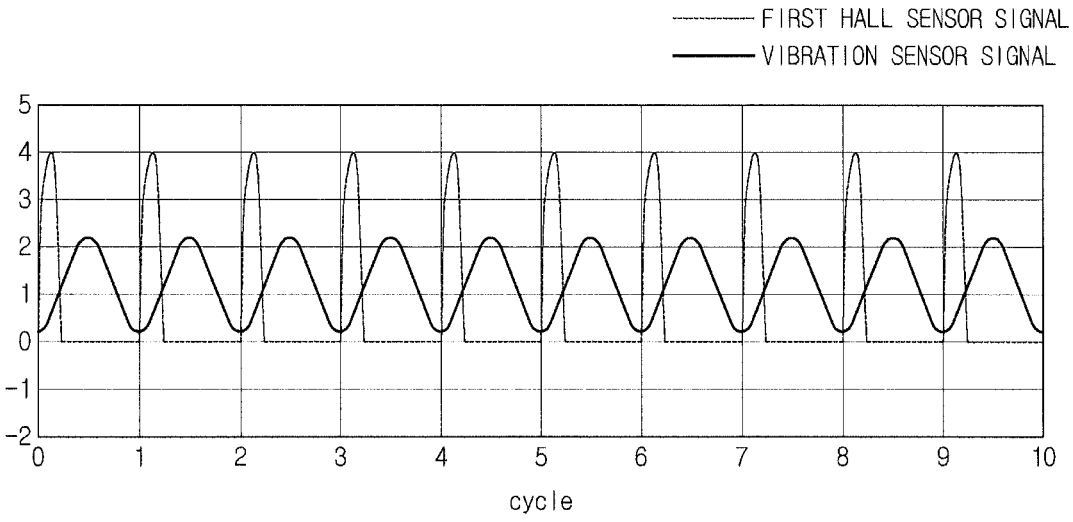
FIG. 7 is a graph representing signal waveforms of the Hall sensor and a vibration sensor of the washing machine in accordance with the embodiment of the present invention.

FIG. 6 is a graph representing signal waveforms of the Hall sensors of the washing machine 1 in accordance with the embodiment of the present invention, and FIG. 7 is a graph representing signal waveforms of the Hall sensor and the vibration sensor 21 of the washing machine 1 in accordance with the embodiment of the present invention.

The controller 80 detects the position of the balancing module 113 through a phase difference between signal waveforms generated by the first Hall sensor 22 and the second Hall sensor 23. That is, the controller 80 detects the relative position of the balancing module 113 with respect to the position of the first magnetic body 36 mounted on the external surface of the drum 30 as a reference position.

When the balancing module 113 is located at the same position as the first magnetic body 36 in the circumferential direction, the first Hall sensor 22 and the second Hall sensor 23 generate signals at the same point of time and thus the two signals coincide with each other without a phase difference. As the positions of the balancing module 113 and the first magnetic body 36 are changed, a phase difference between the two signals occurs. Through such a phase difference, the relative position of the balancing module 113 with respect to the first magnetic body 36 may be detected.

If two balancing modules 113 are disposed in one balancer 100, the second magnetic bodies 125 mounted on the respective balancing modules 113 may be varied or the numbers of the second magnetic bodies 125 mounted on the balancing modules 113 may be varied to identify the respective balancing modules 113.

The controller 80 may detect the intensity and position of unbalance applied to the drum 30 as results of sensing by the first Hall sensor 22 and the vibration sensors 21.

If unbalance is applied to the drum 30, a signal measured by the vibration sensor 21 generally has a sinusoidal waveform having periodicity (the graph represented by the solid line in FIG. 7). The controller 80 detects the intensity of unbalance applied to the drum 30 through the intensity of such a signal.

In the same manner as detection of the position of the balancing module 130, a position to which balance is applied is detected through a phase difference between the signal waveform generated by the first Hall sensor 22 and the signal waveform generated by the vibration sensors 21. That is, the relative position of unbalance with respect to the position of the first magnetic body 36 mounted on the external surface of the drum 30 as a reference position is detected.

If unbalanced load generating unbalance is present at the same position as the first magnetic body 36 in the circumferential direction, the first Hall sensor 22 and the vibration sensors 21 generate signals at the same point of time and thus there is no phase difference between the two signals. As the positions of the unbalanced load and the first magnetic body 36 are changed, a phase difference between the two signals occurs. Through such a phase difference, the relative position of the unbalanced load with respect to the first magnetic body 36 may be detected, and thus the direction of unbalance generated due to the unbalanced load may be detected.

As described above, the controller 80 detects the intensity and position of the unbalance and the positions of the balancing modules 113 based on results of sensing by the vibration sensors 21, the first Hall sensor 22 and the second Hall sensors 23, and determines the positions of the balancing modules 113 to effectively compensate for the unbalance therethrough. If two balancing modules 113 are used, the positions of the two balancing modules 113 where the unbalance is compensated for by applying the sum of centrifugal forces by the two balancing modules 113 in the opposite direction of centrifugal force by eccentric laundry are determined. That is, in this case, the two balancing modules 113 are located to be symmetrical with respect to an axis to which the unbalance is applied, and an angle formed by the two balancing modules 13 from the axis is determined by the intensity of the unbalance.

When the position of the balancing module 113 to compensate for the unbalance is determined, the controller 80 generates a control signal to move the balancing module 113 to the corresponding position and transmits the control signal to the balancing module 113, and the communication unit 120 of the balancing module 113 receives the control signal.

The drive unit 121 of the balancing module 113 transmits drive force to move the balancing module 113 to the position to compensate for the unbalance to the wheel 122 according to the control signal received by the communication unit 120, and the wheel 122 moves the balancing module 113 using the received drive force.

Figure 8:
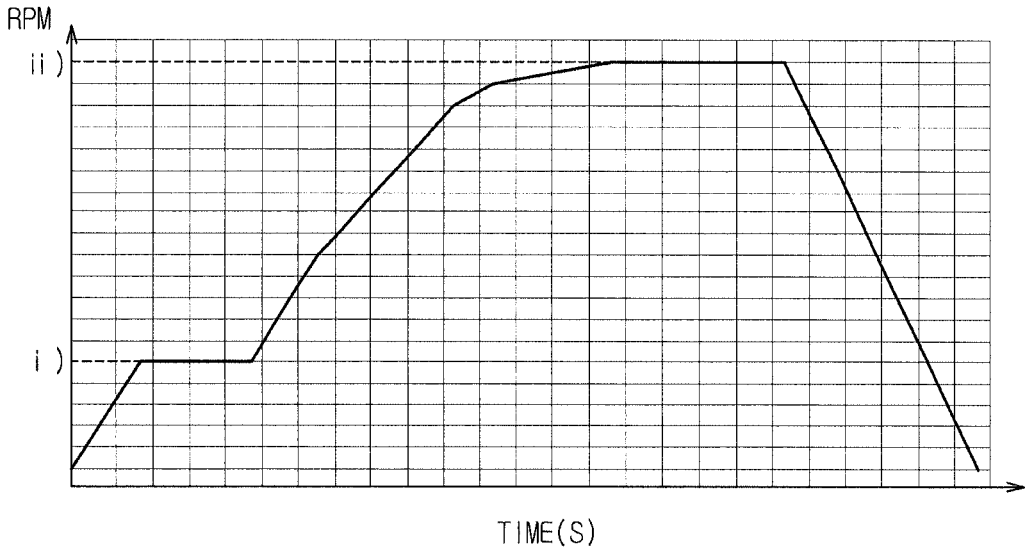
FIG. 8 is a graph representing RPM of a motor according to time during a spin-drying cycle of the washing machine in accordance with the embodiment of the present invention.
Figure 9A:
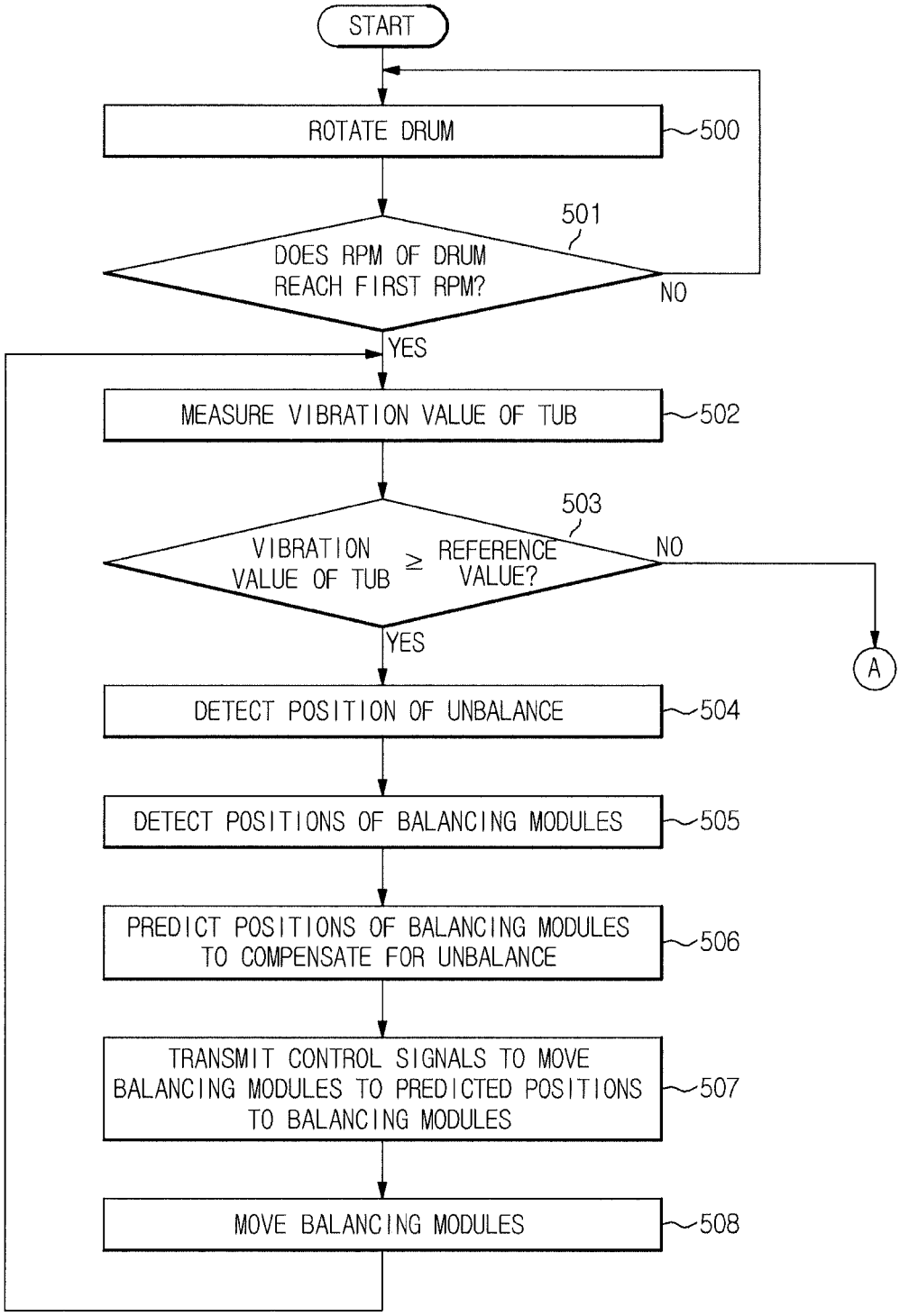
FIGS. 9A to 9C are flowcharts illustrating a control method of the balancing modules of the washing machine in accordance with the embodiment of the present invention.
Figure 9B:
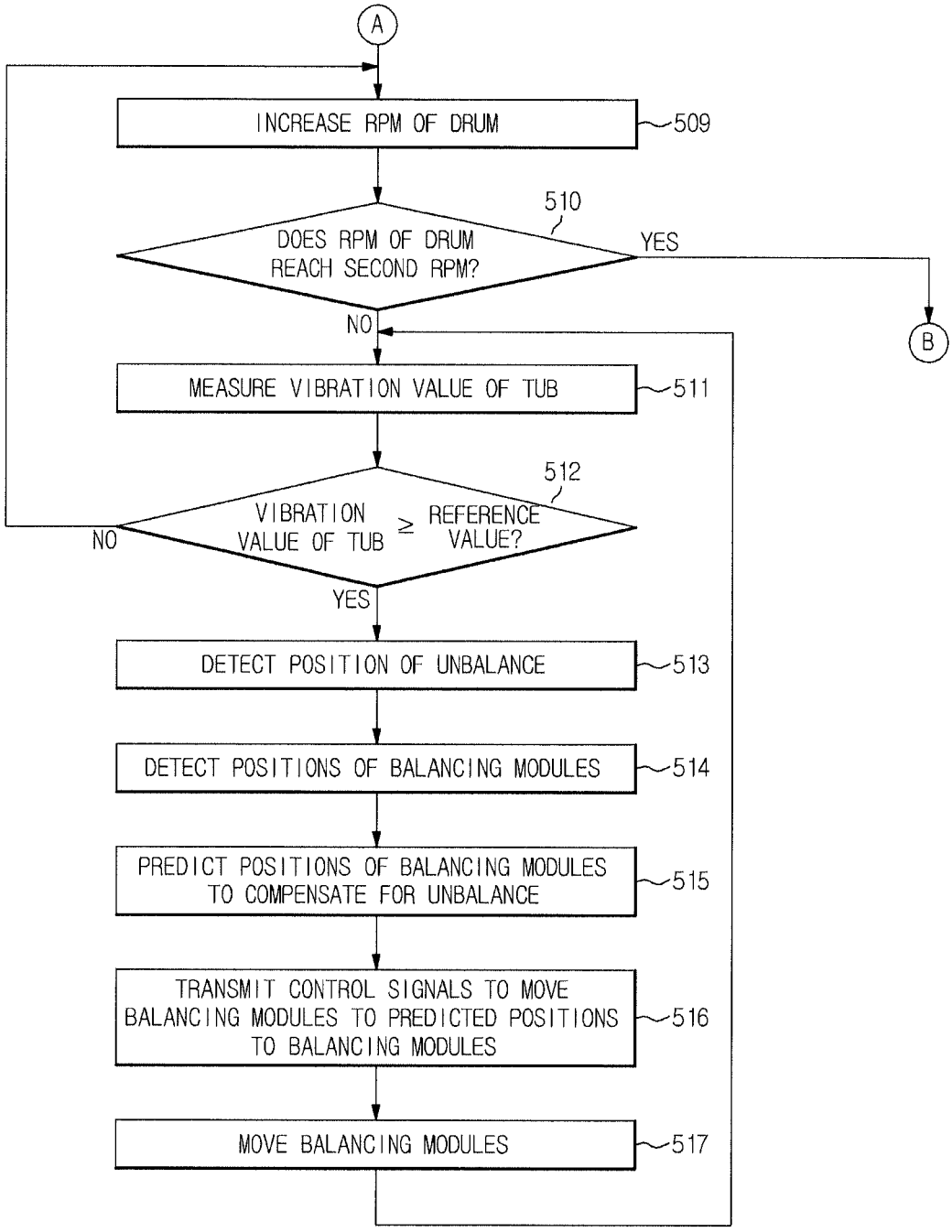
Figure 9C:
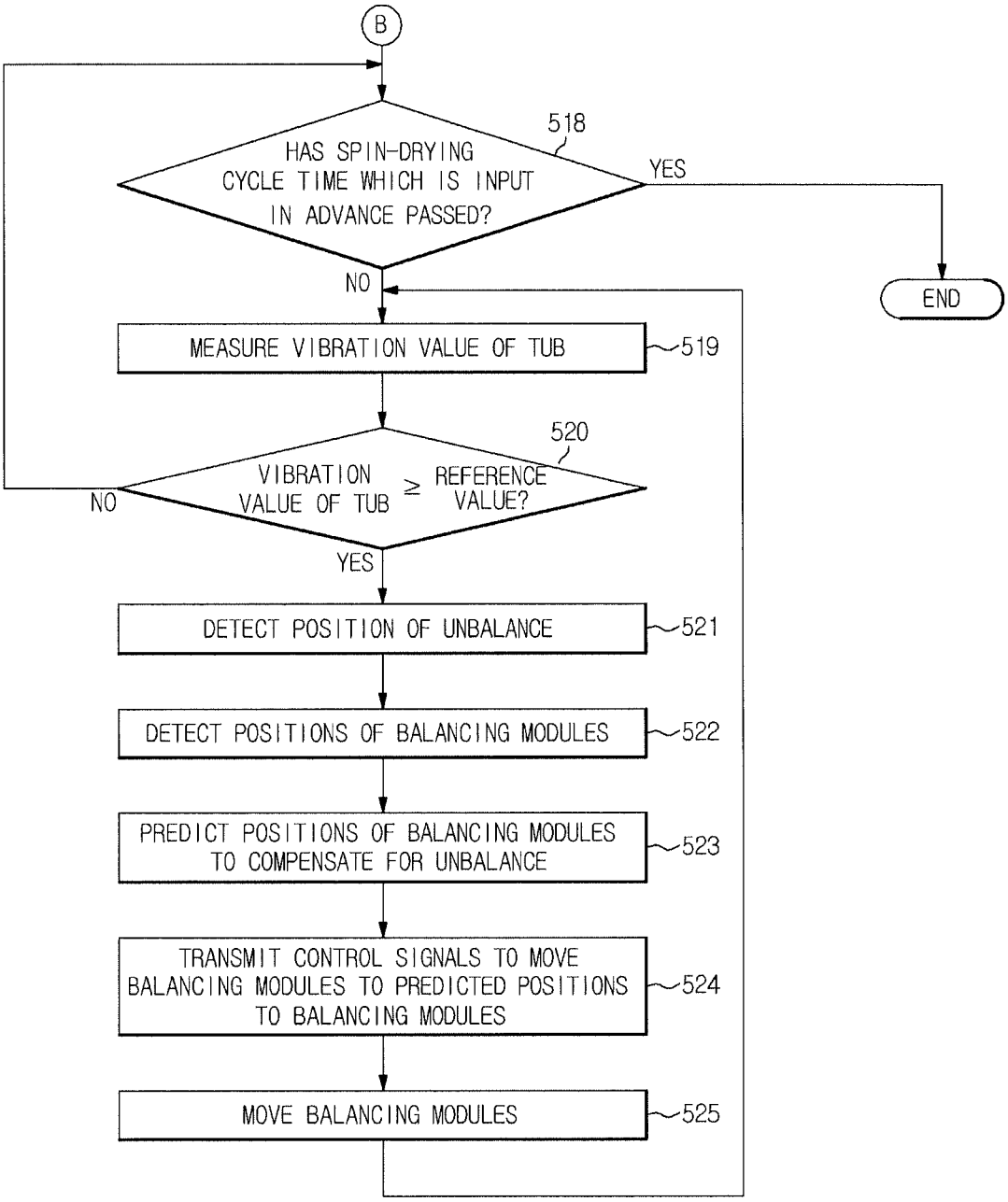

FIG. 8 is a graph representing RPM of the motor according to time during the spin-drying cycle of the washing machine in accordance with the embodiment of the present invention, and FIGS. 9A to 9C are flowcharts illustrating a control method of the balancing modules 113 of the washing machine 1 in accordance with one embodiment of the present invention.

With reference to FIG. 9A, the controller 80 rotates the drum 30 to conduct spin-drying of laundry (Operation 500). When the drum 30 is rotated to conduct spin-drying of the laundry, free movement of the laundry is restricted by centrifugal force.

The controller 80 detects the RPM of the drum 30, and judges whether or not the RPM of the drum 30 reaches a first RPM (Operation 501). Upon judging that the RPM of the drum 30 has not reached the first RPM, the controller 80 rotates the drum 30 at a higher velocity until the RPM of the drum 30 has reached the first RPM.

A liquid balancer or a ball balancer installed on the conventional washing machine exhibits a balancing function to compensate for unbalance after a designated RPM (for example, after 300~400 RPM), but does not exhibit balancing effects at a specific RPM (for example, 100~350 RPM) or rather increases the unbalance. Therefore, in the present invention, in order to reduce unbalance at an operation section of the above-described specific RPM, whether or not the drum reaches the operation section of the corresponding RPM is judged, and then a balancing process to compensate for the unbalance is conducted when the drum has reached the operation section of the corresponding RPM. Therefore, the first RPM may be set to a value within a range of 100~350 RPM more than a RPM (for example, 100 RPM) at which laundry is fixed in the drum by centrifugal force during spin-drying of the laundry and be preferably set to 250 RPM (with reference to i of FIG. 8), without being limited thereto.

The controller 80 detects a vibration value of the tub 20 when the RPM of the drum 30 has reached the first RPM (Operation 502). The controller 80 detects a degree of vibration of the tub 20 by receiving a result of sensing by the vibration sensors 21 mounted on the tub 20 during rotation of the drum 30.

The controller 80 compares the detected vibration value with a reference value (Operation 503). As a result of the comparison, upon judging that the vibration value of the tub 20 is equal to or greater than the reference value, the controller 80 judges that unbalance is applied to the drum 30 and conducts balancing to compensate for the unbalance.

The controller 80 detects an intensity and position of the unbalance applied to the drum 30 by receiving a result of sensing by the first Hall sensor 22 and the vibration sensors 21 during rotation of the drum 30 (Operation 504). The controller 80 detects the intensity of the unbalance through sizes of signals sensed by the vibration sensor 21, and detects the relative position of the unbalance with respect to the position of the first magnetic body 36 mounted on the external surface of the drum 30 through phase differences between a signal sensed by the first Hall sensor 22 sensing the first magnetic body 36 mounted on the surface of the drum 30 and signals sensed by the vibration sensors 21 sensing vibration of the tub 20.

Further, the controller 80 detects the positions of the balancing modules 113 by receiving results of sensing by the first Hall sensor 22 and the second Hall sensors 23 during rotation of the drum 30 (Operation 505). The controller 80 detects the relative positions of the balancing modules 113 with respect to the position of the first magnetic body 36 mounted on the external surface of the drum 30 through phase differences between a signal sensed by the first Hall sensor 22 sensing the first magnetic body 36 mounted on the surface of the drum 30 and signals sensed by the second Hall sensors 23 mounted on the balancing modules 113.

The controller 80 predicts the positions of the balancing modules 113 to compensate for the unbalance applied to the drum 30 based on results of detection of the intensity and position of the unbalance and the positions of the balancing modules 113 (Operation 506). If one balancer 100 includes two balancing modules 113, the controller 80 determines the positions of the balancing modules 113 to compensate for the unbalance by applying the sum of centrifugal forces by the two balancing modules 113 in the opposite direction of centrifugal force by the laundry.

The controller 80 generates control signals to move the balancing modules 113 to the predicted positions, and transmits the control signals to the balancing modules 113 (Operation 507). When the communication unit 120 of the balancing module 113 receives the control signal from the controller 80, the drive unit 121 generates drive force to move the balancing module 113 according to the control signal and then drives the wheel 122, thereby moving the balancing module 113 to the position to compensate for the unbalance (Operation 508). When the balancing module 113 moves to the position to compensate for the unbalance, rotation of the wheel 122 is stopped through cogging torque of the drive unit motor, thereby stopping movement of the balancing module 113. Here, the wheel 122 may be formed a material providing high frictional force, such as rubber.

The controller 80 re-detects the vibration value of the tub 20 and compares the vibration value of the tub 20 with the reference value, when the balancing modules 113 move to the positions to compensate for the unbalance, thereby judging whether or not the unbalance is compensated for.

With reference to FIG. 9B, the controller 80 increases the RPM of the drum 30 by increasing the rotating velocity of the drum 30 upon judging that the vibration value of the tub 20 is smaller than the reference value (Operation 509).

The controller 80 detects the RPM of the drum 30 and judges whether or not the RPM of the drum 30 reaches a second RPM (Operation 510). Here, the second RPM may be set to the maximum RPM of the drum 30 to conduct the spin-drying cycle (with reference to ii of FIG. 8) or be variously set according to a spin-drying mode, and then be input to the washing machine 1 in advance.

Upon judging that the RPM of the drum 30 has not reached the second RPM, the controller 80 detects the vibration value of the tub 20 (Operation 511). The controller 80 detect a degree of vibration of the tub 20 by receiving a result of sensing by the vibration sensors 21 mounted on the tub 20 during rotation of the drum 30. In comparison with the initial stage of the spin-drying cycle, the amount of water contained in the laundry is gradually decreased as the spin-drying cycle progresses. Therefore, the controller 80 continuously detects the degree of vibration of the tub 20 until the RPM of the drum 30 has been increased and then reached the second RPM after the first balancing process shown in FIG. 9A has been completed, thereby coping with change of the intensity of the unbalance.

The controller 80 compares the detected vibration value with the reference value (Operation 512). As a result of the comparison, the controller 80 judges that unbalance is applied to the drum 30 and conducts second balancing to compensate for the unbalance upon judging that the vibration value of the tub 20 is equal to or greater than the reference value, and increases the RPM of the drum 30 by increasing the rotating velocity of the drum 30 upon judging that the vibration value of the tub 20 is smaller than the reference value (Operation 509).

Thereafter, Operations 513 to 517 are equal to Operations 504 to 508 of FIG. 9A, and a detailed description thereof will thus be omitted.

When the RPM of the drum 30 has reached the second RPM, the controller 80 continuously conducts the spin-drying cycle until a spin-drying cycle time which is input in advance has passed, and monitors in real time whether or not unbalance is applied to the drum 30 until the spin-drying cycle has been completed, thereby continuously conducting the balancing process.

With reference to FIG. 9C, the controller 80 judges whether or not the spin-drying cycle time which is input in advance has passed (Operation 518). The controller 80 detects the vibration value of the tub 20, upon judging that the spin-drying cycle time has not passed (Operation 519). The controller 80 detects a degree of vibration of the tub 20 by receiving results of sensing by the vibration sensors 21 mounted on the tub 20 during rotation of the drum 30.

The controller 80 compares the detected vibration value with the reference value (Operation 520). As a result of comparison, the controller 80 judges that unbalance is applied to the drum 30 and conducts third balancing to compensate for the unbalance upon judging that the vibration value of the tub 20 is equal to or greater than the reference value, and judges whether or not the spin-drying cycle time has passed, if the vibration value of the tub 20 detected after conduction of the third balancing is smaller than the reference value.

Thereafter, Operations 521 to 525 are equal to Operations 504 to 508 of FIG. 9A, and a detailed description thereof will thus be omitted.

As described above, the washing machine in accordance with the embodiment may continuously conduct the balancing process by monitoring in real time whether or not unbalance is applied to the drum 30 from when the spin-drying cycle is started until the spin-drying cycle has been completed.

As is apparent from the above description, a washing machine in accordance with one embodiment controls unbalance applied to a drum during a spin-drying cycle in a short period of time.

Further, the washing machine reduces vibration due to unbalance during the spin-drying cycle, thereby being designed to have a greater capacity.

Moreover, the washing machine removes or minimizes a vibration suppression unit, such as a damper, thereby reducing production costs.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a drum accommodating laundry and rotated by rotary force transmitted from a drive source;

one or more balancer housings mounted on the drum, each of the balancer housings including a disc-shaped channel formed therein;

one or more balancing modules movably disposed in the channels of each balancer housings;

vibration sensor mounted on a tub to sense unbalance applied to the drum during rotation of the drum;

a first position identification unit mounted on the drum;

a first position sensor to sense the first position identification unit and to generate a reference signal to determine a position of the unbalance and a position of the balancing module;

a second position identification unit mounted on the balancing module;

a second position sensor to sense the second position identification unit; and a controller to determine a first position of the balancing module relative to the first position identification unit through a phase difference between the reference signal of the first position sensor and a sensing signal of the second position sensor, determine a second position of the balancing module to compensate for the unbalance, and control the balancing module to move to the second position.

2. The washing machine according to claim 1, wherein:

each of the balancing modules includes:

a mass body;

a communication unit to receive a control signal from the controller;

the drive unit to generate drive force to move the balancing module within the balancing housing according to the control signal.

3. The washing machine according to claim 1, wherein each of the position sensors includes one of a Hall sensor, an infrared sensor and an optical fiber sensor.

4. The washing machine according to claim 3, wherein each of the position identification units includes one of a magnetic body, a light emitting unit and a reflective plate.

5. The washing machine according to claim 1, wherein the controller:

detects the unbalance through signals sensed by the vibration sensors; and detects the relative position of the unbalance with respect to the position of the first position identification unit through phase differences between the reference signal of the first position sensor and the signals sensed by the vibration sensors.

6. The washing machine according to claim 1, wherein the vibration sensor includes a plurality of vibration sensors, and the plurality of vibration sensors are mounted at front and rear ends of an external surface of the tub.

7. The washing machine according to claim 1, wherein:

the drum includes a cylindrical member and front and rear plates respectively disposed at the front and rear portions of the cylindrical member;

the one or more balancing housing include a first balancer housing and a second balancer housing; and the first balancer housing and the second balancer housing are respectively mounted on the front plate and the rear plate.

8. The washing machine according to claim 1, wherein the balancing modules have a rod shape extending in the circumferential direction of the disc-shaped channel.

* * * * *

UNITED STATES PATENT AND TRADEMARK OFFICE

CERTIFICATE OF CORRECTION

PATENT NO. : 8,950,219 B2
APPLICATION NO. : 13/432721
DATED : February 10, 2015
INVENTOR(S) : Jae Seuk Park et al.

It is certified that error appears in the above-identified patent and that said Letters Patent is hereby corrected as shown below:

Title page

Item (75) Inventors

Delete "Yingin-si" and insert --Yongin-si--, therefor.

Signed and Sealed this
Thirteenth Day of October, 2015

Michelle K. Lee

Michelle K. Lee
*Director of the United States Patent and Trademark Office*